US008330781B2

(12) United States Patent
Osawa et al.

(10) Patent No.: US 8,330,781 B2
(45) Date of Patent: Dec. 11, 2012

(54) THERMAL HEAD AND PRINTER

(75) Inventors: Kohei Osawa, Suwa (JP); Satoshi Nakajima, Azumino (JP); Akira Koyabu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 906 days.

(21) Appl. No.: 12/283,967

(22) Filed: Sep. 17, 2008

(65) Prior Publication Data

US 2009/0225149 A1 Sep. 10, 2009

(30) Foreign Application Priority Data

Mar. 5, 2008 (JP) ..... 2008-054454

(51) Int. Cl.

| | |
|---|---|
| ***B41J 2/335*** | (2006.01) |
| ***B41J 2/05*** | (2006.01) |
| ***B41J 2/32*** | (2006.01) |
| ***B41J 2/00*** | (2006.01) |
| ***B41J 2/34*** | (2006.01) |
| ***B41J 2/435*** | (2006.01) |

(52) U.S. Cl. ..... 347/204; 347/61; 347/171; 347/195; 347/208; 347/262

(58) Field of Classification Search ..... None
See application file for complete search history.

(56) References Cited

U.S. PATENT DOCUMENTS

| | | | | |
|---|---|---|---|---|
| 5,623,298 | A | 4/1997 | Motoyama et al. | |
| 6,344,868 | B1 * | 2/2002 | Susukida et al. | 347/202 |
| 6,407,764 | B1 * | 6/2002 | Susukida et al. | 347/209 |
| 6,409,309 | B1 * | 6/2002 | Tanikawa et al. | 347/54 |
| 6,822,665 | B2 * | 11/2004 | Sugiyama et al. | 347/200 |
| 7,538,785 | B2 | 5/2009 | Yamamoto et al. | |

FOREIGN PATENT DOCUMENTS

| | | | |
|---|---|---|---|
| JP | 04-043051 | A | 2/1992 |
| JP | 05-131664 | | 5/1993 |
| JP | 05-270030 | A | 10/1993 |
| JP | 06-047939 | | 2/1994 |
| JP | 06-218973 | | 8/1994 |
| JP | 7-137317 | | 5/1995 |
| JP | 2001-080100 | A | 3/2001 |
| WO | WO-2005120841 | A1 | 12/2005 |

* cited by examiner

*Primary Examiner* — Jason S Uhlenhake
*Assistant Examiner* — Alexander C Witkowski
(74) *Attorney, Agent, or Firm* — Nutter McClennen & Fish LLP; John J. Penny, Jr.; Rory P. Pheiffer

(57) ABSTRACT

A thermal head avoids a drop in print quality caused by adhesion of printing chaff. A thermal head 39 that presses against thermal paper that moves from one side to the other side and prints by melting dye contained in the thermal paper has a glazed layer 150 that is formed in an area on one part of a ceramic substrate 43 and stores in-flowing heat, and a heating resistor 140 that is located offset to one side from the center of the glazed layer 150, selectively heats the thermal paper S pressed in contact therewith, and melts a dye material contained in the thermal paper. A smooth surface P against which the thermal paper S heated by the heating resistor 140 slides is formed to the other side of the glazed layer 150 from the heating resistor 140.

8 Claims, 8 Drawing Sheets

THERMAL HEAD AND PRINTER

BACKGROUND OF THE INVENTION

1. Field of Invention

The present invention relates to a thermal head and to a printer that prints by selectively heating thermal paper that reacts to heat energy.

2. Description of Related Art

Thermal printers are a common type of printer. Thermal printers use a thermal head having small heating elements that selectively produce heat when energized arrayed in a line on a ceramic substrate. Thermal printers use a thermochromic printing technique to print on thermo-sensitive paper (thermal paper) by selectively melting dyes contained in the coating on the thermal paper. The thermal head used in this thermochromic printing method has a glazed layer that functions as a heat storage layer below the small heating elements as taught in Japanese Unexamined Patent Appl. Pub. JP-A-H07-137317. There are two types of glazed layers, a flat glazed type in which the glazed layer covers substantially the entire surface of the ceramic substrate, and a partially glazed type in which the glazed layer is formed only around the heating elements. The partially glazed type is widely used today because its high speed heat dissipation performance avoids the ghosting effect produced by residual heat in the heating elements during high speed printing when the heating elements are caused to respond rapidly.

The thermal paper has an undercoating applied to the base paper fiber matrix, and a thermochromic coating is then applied over the undercoating. In addition to improving the smoothness of the thermal paper, the undercoating also functions to cool the melted dye and fix the color.

However, thermal paper that does not have this undercoating is also widely used as a low cost thermal paper. With this type of paper the melted dye may separate before it can cool and be fixed, and printing chaff such as the melted dye then clings to and accumulates on the shoulder of the glazed layer adjacent to the heating elements. As this chaff accumulates, optical density, which is a measure of print density, drops as shown in FIG. 8, printing therefore becomes lighter, and print quality drops. Such printers are also preferably compact and as inexpensive as possible.

SUMMARY OF THE INVENTION

A printer according to a preferred aspect of the invention has a thermal head that prints on thermal paper, and a roller that is disposed opposite the thermal head with the thermal paper therebetween and conveys the thermal paper. The thermal head includes a substrate; a heat storage layer formed on a part of the substrate for storing input heat; and a heating element formed on the heat storage layer for melting a dye agent contained in the thermal paper; and the heating element is disposed on the upstream side in the thermal paper transportation direction from the center of the heat storage layer.

Because the heating element is disposed on the upstream side in the thermal paper transportation direction from the center of the heat storage layer, the thermal paper heated by the heating element cools gradually while in contact with the heat storage layer. The printing chaff that results while the dye agent contained in the thermal paper cools from the melted state is thus produced gradually, the chaff does not adhere and accumulate in one location, and a drop in print quality caused by printing chaff can therefore be avoided. Furthermore, because the size of the heat storage layer itself does not change, the conventional size of the printer can be maintained and the cost can be kept down.

Preferably, a surface is formed parallel to the substrate contacting the thermal paper on the heat storage layer downstream in the thermal paper transportation direction from the heating element.

This aspect of the invention enables the thermal paper to separate more smoothly so that the printing chaff does not adhere and accumulate in one location, and a drop in print quality caused by the printing chaff can be avoided.

Further preferably, the width of the heat storage layer is 1.5 mm or greater.

By rendering the heat storage layer in this range, a suitable heat storage effect can be achieved, adhesion of printing chaff can be reduced, and printing is possible without a drop in quality.

Yet further preferably, the thickness of the heat storage layer is uniform. This enables a printer that can maintain print quality while printing at a high speed because the color coating layer of the thermal paper that is heated by the heating element cools gradually while held reliably in contact with the heat storage layer.

Yet further preferably, the heating element is aligned in a direction intersecting the transportation direction of the thermal paper. This enables a printer that can maintain print quality while printing at a high speed.

Yet further preferably, the roller is disposed so that the position where a perpendicular to the substrate of the thermal head passing through the axial center of the roller intersects the thermal head is located on the downstream side in the thermal paper transportation direction from the position where the heating element is formed. This improves the printing chaff removal effect, and avoids a drop in print quality caused by printing chaff.

Other objects and attainments together with a fuller understanding of the invention will become apparent and appreciated by referring to the following description and claims taken in conjunction with the accompanying drawings.

DESCRIPTION OF PREFERRED EMBODIMENTS

Figure 1:
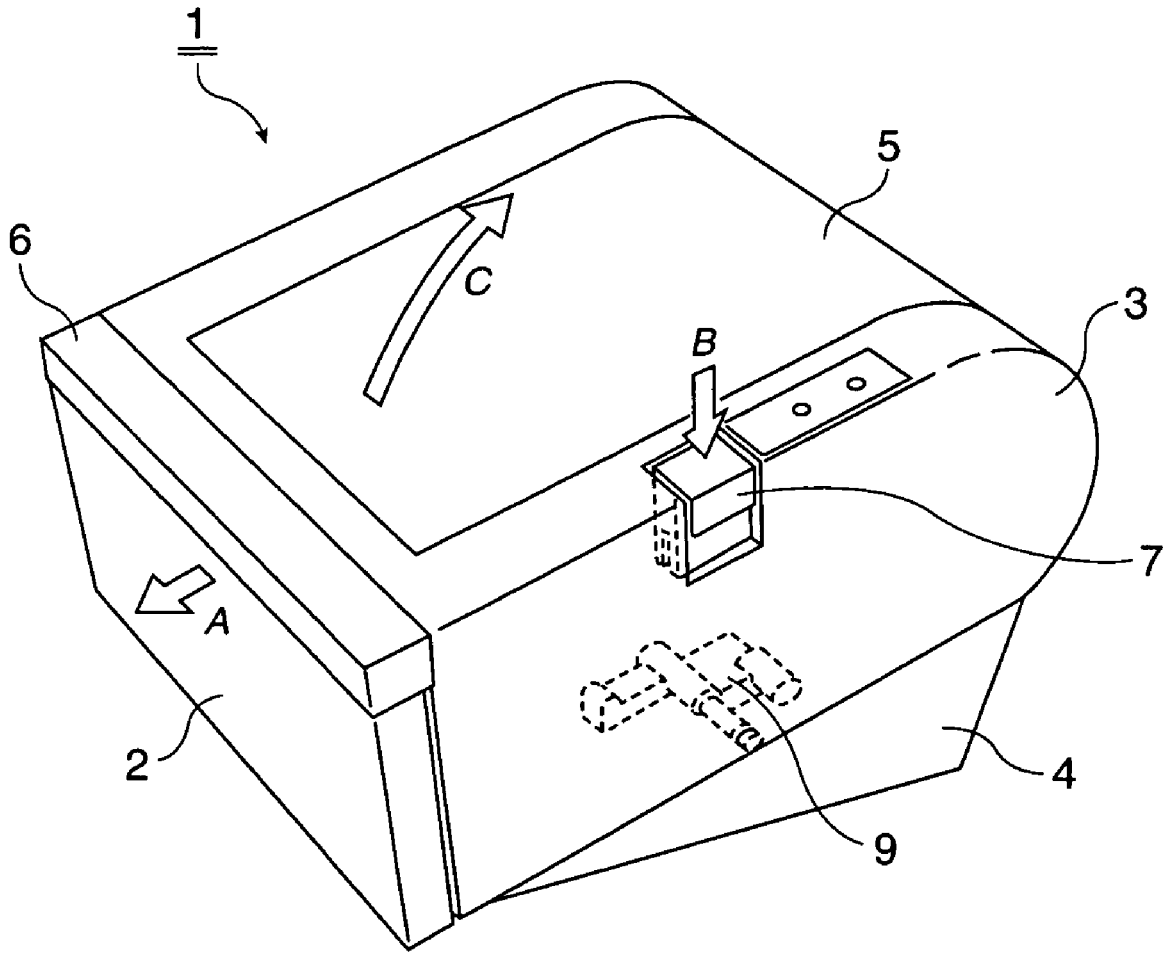
FIG. 1 is an oblique view showing the appearance of a printer according to a preferred embodiment of the invention.

FIG. 1 is an oblique view showing the appearance of a printer 1 using a thermal head according to a preferred embodiment of the invention. The printer 1 is a thermal printer that is used as a receipt printer in a POS system, for example. The printer 1 uses thermal paper S that is wound in a roll (see FIG. 4), and has a print mechanism unit (FIG. 2) for printing information on the thermal paper S, a paper cutting unit for cutting the printed thermal paper S, and a roll paper compartment for storing the thermal paper S.

The print mechanism unit 8 (FIG. 2) is attached to a bottom case 4 made of plastic, the side and back portions are covered by a top case 3, and the front portion is covered by a panel 2. A paper cutter unit is disposed at the top of the panel 2. The paper cutter unit is covered by a cutter cover 6, and the cutter cover 6 can be slid out in the direction of arrow A.

An open button 7 that drives an internal cover opening lever 9 to rotate an internal cover frame 10 (FIG. 2) in order to remove the thermal paper S is disposed at one side of the top case 3. This cover frame 10 (FIG. 2) is connected to a top cover 5. When the open button 7 is pressed in the direction of arrow B, the cover opening lever 9 rotates clockwise and a lock mechanism disengages so that the top cover 5 can open in the direction of arrow C and the roll paper compartment 17 (FIG. 2) is exposed.

Figure 2:
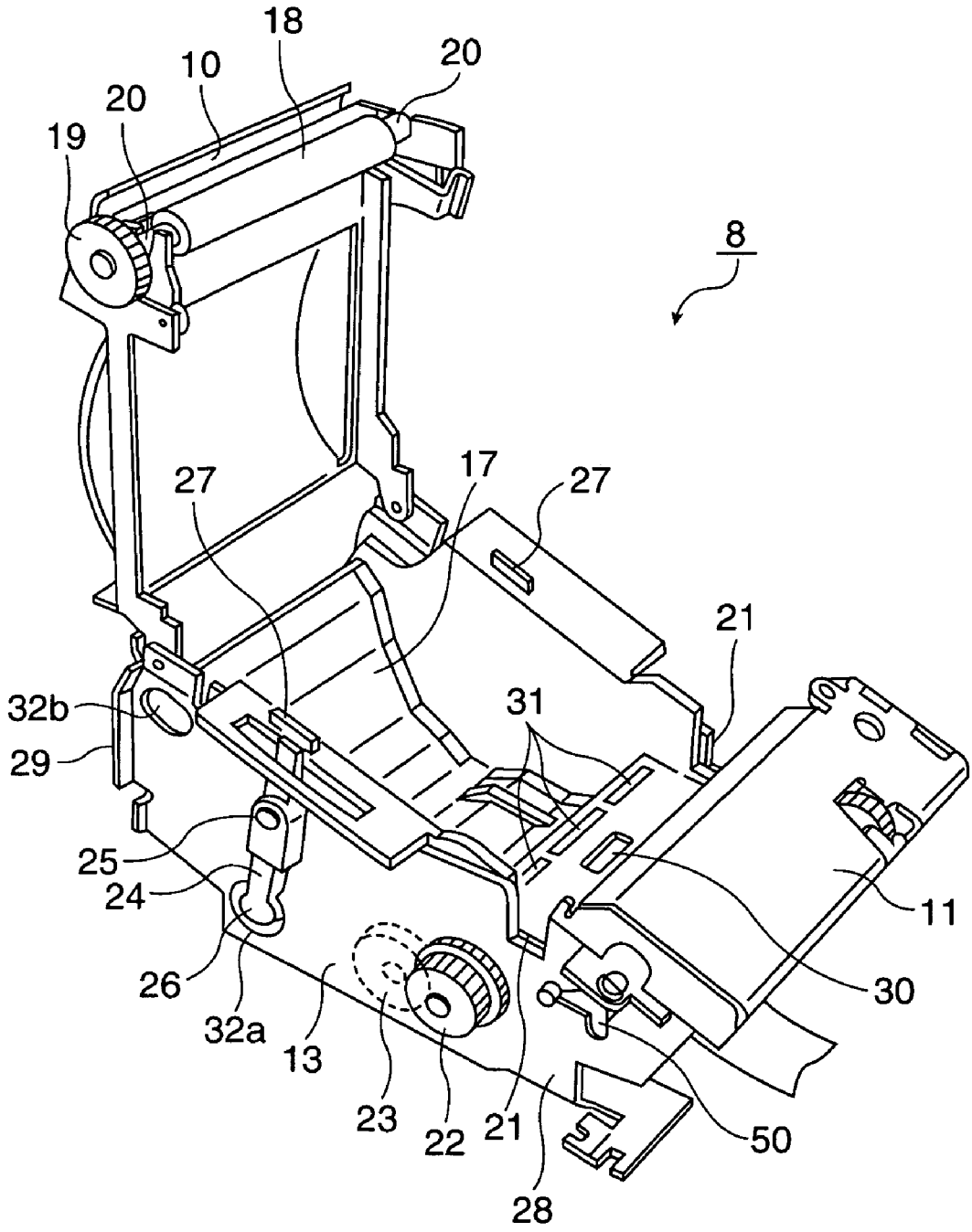
FIG. 2 is an oblique view of the print mechanism unit when the cover frame is open.
Figure 3:
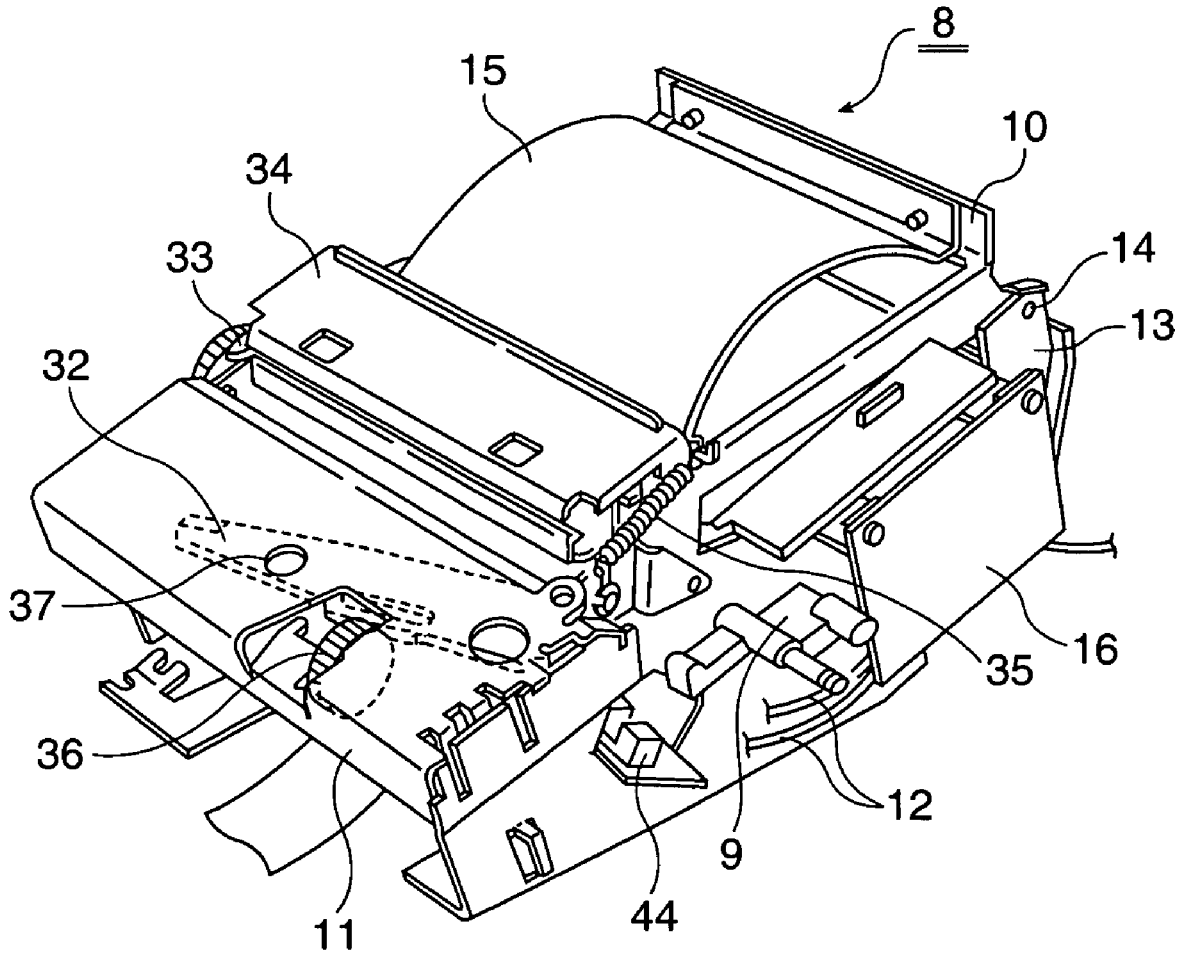
FIG. 3 is an oblique view of the print mechanism unit when the cover frame is closed.

FIG. 2 and FIG. 3 are oblique views of the print mechanism unit 8, FIG. 2 being an oblique view of the print mechanism unit 8 when the cover frame 10 is open, and FIG. 3 being an oblique view of the print mechanism unit 8 when the cover frame 10 is closed.

The print mechanism unit 8 has a cover frame 10 that opens and closes freely to the top of a main frame 13 that is typically metal, and an automatic paper cutter unit 11 that houses a movable knife 32 and a drive means for the movable knife. When the thermal paper S is not cut, the movable knife 32 is stored inside the automatic paper cutter unit 11 and the movable knife 32 is not exposed. When thus positioned, the movable knife 32 is said to be in the standby position.

A fixed knife 33 that crosses the movable knife 32 with a scissor action is disposed to the cover frame 10 opposite the automatic paper cutter unit 11. A blade shutter 34 is disposed above the fixed knife 33. The blade shutter 34 is urged by a shutter spring 35 in the direction covering the cutting edge of the fixed knife 33, but when the cover frame 10 is closed as shown in FIG. 3, part of the blade shutter 34 contacts an engaging part disposed to the main frame 13 so that the blade shutter 34 is lifted slightly open. The cutting edge of the fixed knife 33 is thus exposed so that the movable knife 32 can move across the fixed knife 33 with a scissor action to cut the paper.

The cover frame 10 is attached to pivot, that is, open and close freely, on support pins 14 provided at the top part on both sides of the main frame 13. A cover part 15 disposed to the cover frame 10 is curved so that the cover part 15 does not contact the thermal paper S when the cover frame 10 is closed. When the orientation of the printer installation is changed, this cover part 15 also functions as a holding member that receives the thermal paper S.

A cover detector 44 that detects if the cover frame 10 is closed is disposed on the right side of the main frame 13. This cover detector 44 is a transmission type photodetector, and detects whether or not the cover frame 10 is closed correctly based on whether the light beam from the detector is interrupted by a part of the cover frame 10.

A near-end detector 24 and a paper detector 30 described below are also provided in addition to this cover detector 44. Leads 12 from these detectors, the automatic paper cutter unit 11, and a paper transportation motor 23 described below are connected to a relay board attached to the right side of the main frame 13. The relay board and a main circuit board (not shown in the figure) that controls the printer 1 are connected by a flat flexible cable, for example.

A plastic roll paper compartment 17 is disposed inside the open cover frame 10. The paper detector 30 for detecting if paper is present is disposed to the roll paper compartment 17. The paper detector 30 is a reflection type photodetector, and a group of holes 31 is disposed on the upstream side of the paper detector 30. The holes 31 allow foreign matter and chaff clinging to the thermal paper S to drop out so that the paper dust or other foreign matter does not interfere with detector operation. Slots 27 for engaging the right and left side panels of the main frame 13 are also rendered in the roll paper compartment 17. When these slots 27 engage the right and left side panels of the main frame 13, the widthwise position of the roll paper compartment 17 is fixed and the inside of the roll paper compartment is held at a width suitable to the thermal paper S.

A platen 18, which is a cylindrical rubber roller, is supported rotatably on the cover frame 10 by a platen shaft 20. A platen gear 19 is press fit to one end of the platen 18. A groove part 21 is rendered to the main frame 13 so that when the cover frame 10 closes, the platen shaft 20 is guided by a guide incline 45 disposed to the end part of the heat radiation plate 47 (FIG. 4) and then contacts the groove part 21 so that the platen 18 is positioned in a prescribed position. Pressure from the thermal head 39 (FIG. 4) on the platen 18 works to push down on the cover frame 10 and determine the position of the platen 18. The platen gear 19 and paper transportation transfer gear 22 also mesh and power is transmitted from the paper transportation motor 23 to the platen 18, causing the platen 18 to rotate in a predetermined direction.

The near-end detector 24 for detecting if the thermal paper S is near the end of the roll is disposed freely rotatably on a support pin 25 on the left side of the main frame 13. This arrangement enables the near-end detector 24 to be optimally positioned according to the orientation of the printer. For example, when the printer is used with the bottom 28 of the cover frame 10 down as shown in FIG. 2, the actuator 26 of the near-end detector 24 is fixed inside a hole 32*a* rendered in the cover frame 10. When the printer is used with the back 29 of the cover frame 10 down, however, the actuator 26 is fixed in position in a separate hole 32*b*. A support channel unit 50 that supports the thermal head 39 (FIG. 4) and the head pressure plate 41 (FIG. 4) is rendered at the left and right sides of the main frame 13.

Figure 4:
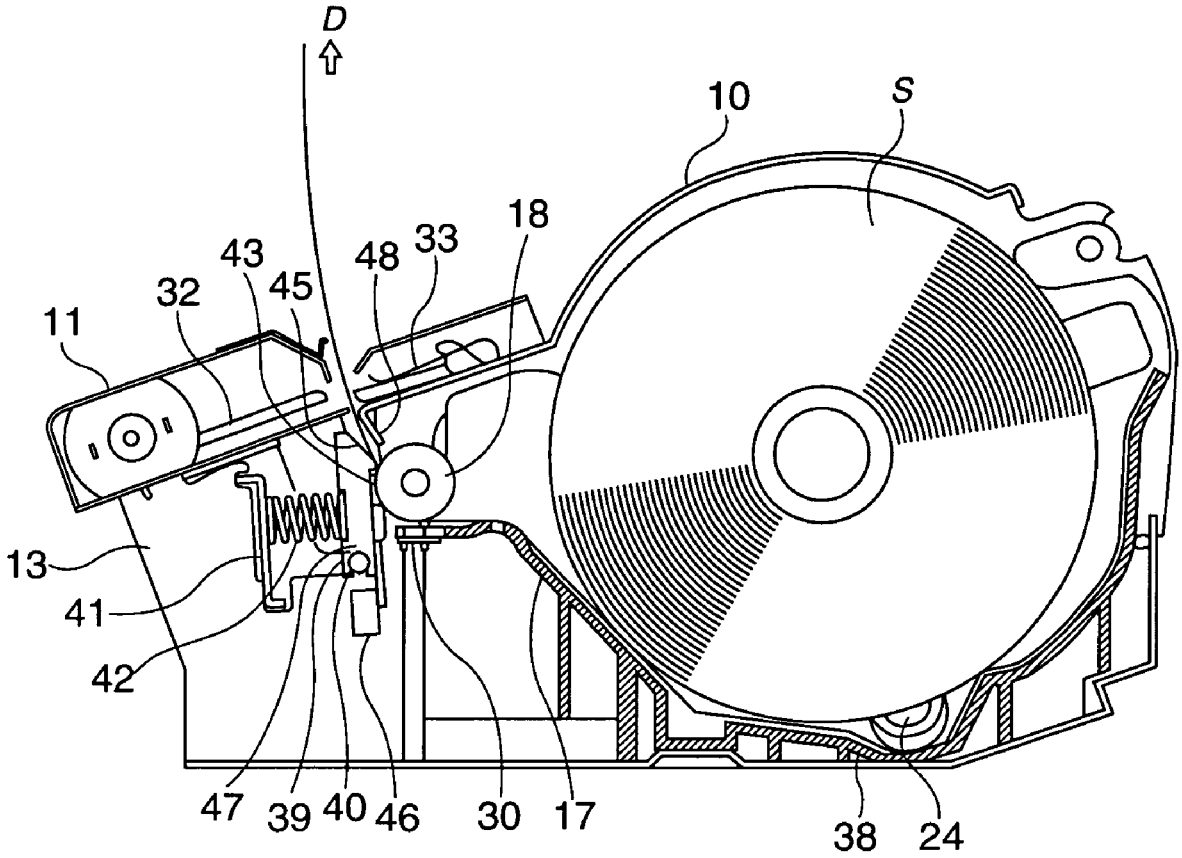
FIG. 4 is a side section view of the print mechanism unit.

FIG. 4 is a side section view of the print mechanism unit 8, and shows the thermal paper S roll paper compartment 17 held in the roll paper compartment 17 with the leading end delivered in the discharge direction (D). FIG. 4 shows the thermal paper S when the diameter is large. As the paper is advanced and the diameter of the thermal paper S becomes small enough, the thermal paper S drops into the recess 38 and the near-end detector 24 thus detects that the roll diameter of the thermal paper S has become a certain small size.

Figure 5:
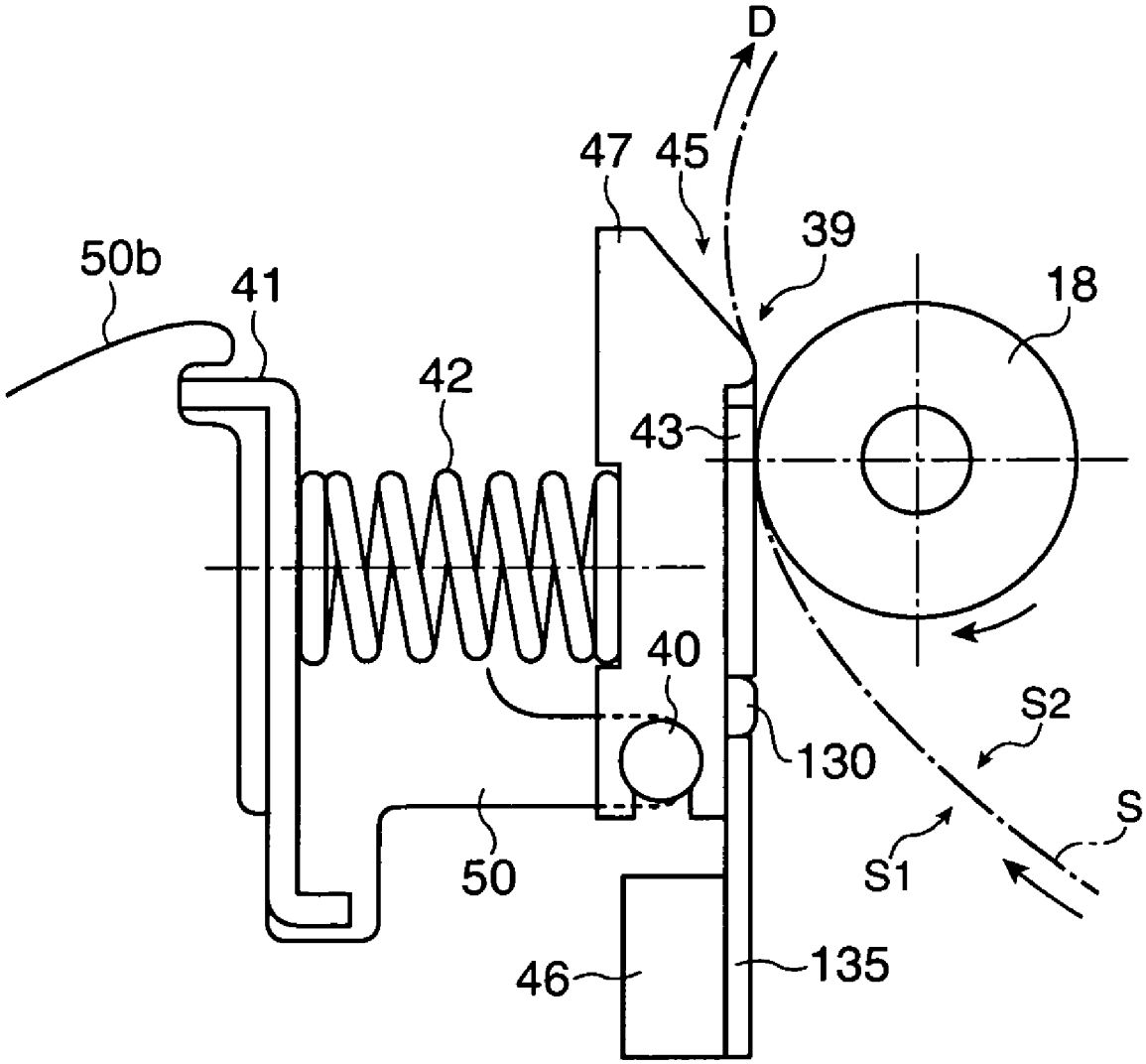
FIG. 5 is a view of the thermal head from the side of the print mechanism.

FIG. 5 is a view showing the thermal head 39 from the side of the print mechanism unit 8. As shown in this figure, the thermal head 39 is based on a heat radiation plate 47. A head support pin 40 is disposed on both sides of the thermal head 39, and the head support pins 40 are supported on a part of the support channel unit 50 disposed to the main frame 13. A ceramic substrate 43 made from an alumina ceramic is disposed on one side of the heat radiation plate 47. This ceramic substrate 43 is located at a position opposite the platen 18, and is urged by a spring 42 disposed on the other side of the heat radiation plate 47 toward the platen 18. The other end of the spring 42 is affixed to the head pressure plate 41, and the head pressure plate 41 is supported by the support channel unit 50*b* disposed to the main frame 13.

With this configuration the thermal paper S is held between the platen 18 and the ceramic substrate 43 with the platen 18 pressing the thermal paper S from the surface S2 on one side of the thermal paper S to the thermal head 39, and the ceramic substrate 43 opposite the platen 18 pressed against the other surface S1 of the thermal paper S.

Figure 6A:
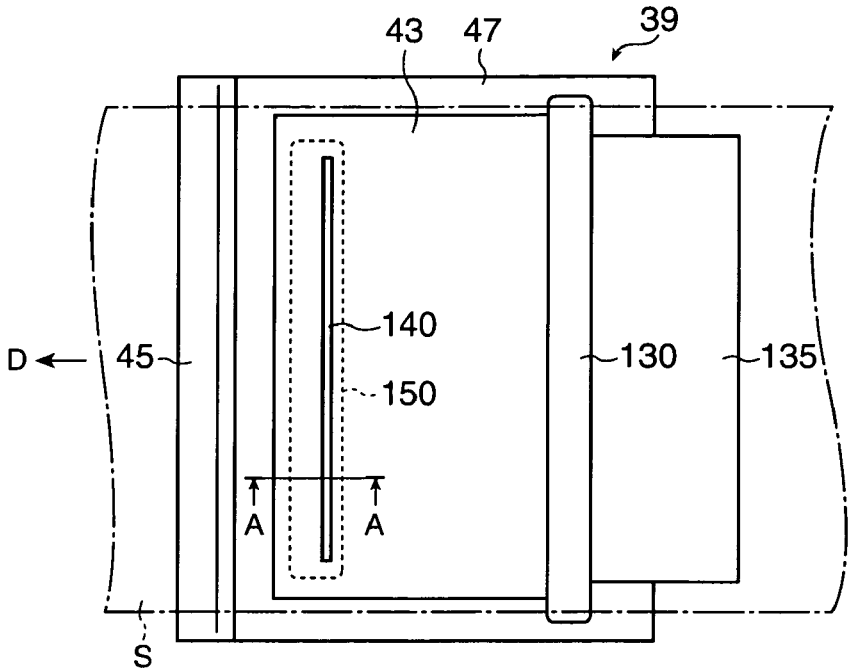
FIG. 6A is a plan view from the platen side of the heating unit of the thermal head.
Figure 6B:
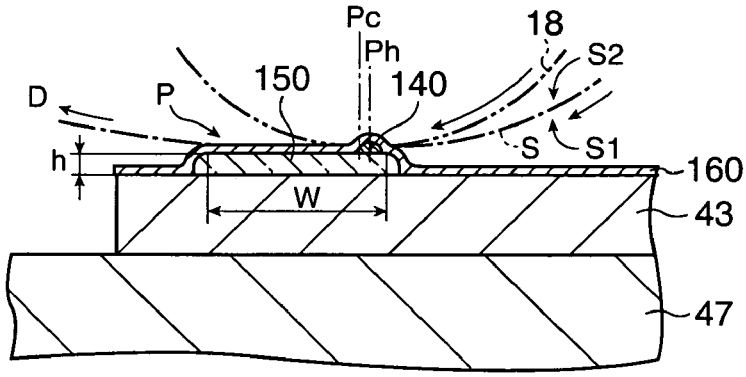
FIG. 6B is a section view of the thermal head.

FIG. 6A is a plan view from the platen 18 side of the of the thermal head 39, and FIG. 6B is a section view of the thermal head 39 through line A-A in FIG. 6A. In FIG. 6 the discharge direction (D) of the thermal paper S is from right to left.

As shown in FIG. 6A and FIG. 6B, a glazed layer 150 of a substantially constant thickness (h) is formed from glass, for example, on the side of the ceramic substrate 43 facing the platen 18 in one area near the end in the direction that the thermal paper S is conveyed (to the left in FIG. 6). A smooth surface P with a predetermined width (W) is formed on the glazed layer 150 substantially parallel to the ceramic substrate 43. A linear heating resistor 140 that converts an applied current to heat is disposed perpendicularly to the discharge direction (D) of the thermal paper on the smooth surface P on the side from which the thermal paper S is conveyed (the right side in FIG. 6).

This heating resistor 140 is approximately 200 μm wide and approximately 6 μm high. The heating resistor 140 has hundreds of fine heating elements arrayed in a line, and by selectively energizing the heating elements, only the energized heating elements instantaneously emit heat. The heating resistor 140 is located on the upstream side of the approximate point of tangency between the platen 18 and the thermal head 39. In other words, the center axis of the platen 18 is located downstream from the heating resistor 140 of the thermal head 39.

The glazed layer 150 functions as a heat storage layer for storing heat coming from the energized heating resistor 140, and also functions to quickly dissipate heat to the heat radiation plate 47 when energizing the heating resistor 140 stops. The glazed layer 150 also functions to smoothen the surface roughness of the ceramic substrate 43, and facilitate forming a fine pattern coated onto the glazed layer 150. Segment electrodes and a common electrode not shown are thus formed on the glazed layer 150 near the heating resistor 140. A protective film 160 made of lead glass, for example, for protecting the parts disposed on the ceramic substrate 43 is also coated over substantially the entire surface over the topmost layer of the glazed layer 150.

An epoxy molding 130 containing a sealed driver chip for selectively energizing the heating resistor 140 is disposed on the ceramic substrate 43 near the end on the side from which the thermal paper S is conveyed (the right side in FIG. 6), and a glass epoxy circuit board 135 wired to the epoxy molding 130 is suspended therefrom. A connector 46 (FIG. 5) connected by a flat flexible cable, for example, to the main circuit board (not shown in the figure) that controls the printer 1 is disposed to other end part of the glass epoxy circuit board 135.

As the platen 18 in this configuration turns, the thermal paper S is conveyed in the discharge direction (D) with pressure applied thereto from the one surface S2 so that the other surface S1 sequentially contacts the heating resistor 140 on the ceramic substrate 43. As the paper advances, the heating resistor 140 emits heat from the heating elements in response to signals sent from the main circuit board (not shown in the figure) through the connector 46. The thermal paper S is thus selectively heated across the width. A color coating with a plurality of dyes held separated by binder is formed on the other surface S1 of the thermal paper S, and the color coating that contacts the energized heating elements changes to a melted state. As the thermal paper S moves, the melted color coating separates from the heating resistor 140 that it touched, pressure is released, and the other surface S1 of the thermal paper S slides over the smooth surface P of the glazed layer 150. Because this other surface S1 is hotter than the smooth surface P, the heat energy of the thermal paper S moves through the smooth surface P of the glazed layer 150 into the glazed layer 150.

However, in addition to the glazed layer 150 already storing heat from the heating resistor 140, the heating resistor 140 is located offset to the right side of the glazed layer 150. Because the smooth surface P is sufficiently long, the melted color coating is not suddenly cooled and instead cools and solidifies gradually. As a result, printing chaff does not occur on one concentrated area of the glazed layer 150, and instead is desirably dispersed. In addition, because the thickness (h) of the glazed layer 150 is substantially constant and the surface is not rough, and the surface roughness of the smooth surface P is smooth, the conveyed thermal paper S can separate smoothly and gradually from the smooth surface P without the printing chaff and dust produced on the other surface S1 adhering to the smooth surface P. As the heated portion of the thermal paper S sequentially separates from the glazed layer 150, the color coating cools further and solidifies. The color of the thermal paper S is therefore fixed and the color coating changes to a stable state. Information corresponding to the print signals is thus sequentially printed on the thermal paper S.

After passing the glazed layer 150, the thermal paper S is conveyed in the discharge direction (D) and the other surface S1 of the thermal paper S contacts the guide incline 45 so that the paper is conveyed upward without curling and is guided into the paper cutter by the guide portions 48 (FIG. 4) disposed to the cover frame 10. The thermal paper S guided to the paper cutter unit passes between the movable knife 32 and fixed knife 33, and is discharged from the printer 1.

The perpendicular Pc to the center axis of the platen 18 is preferably on the discharge side of the center Ph of the heating elements in the thermal head. The platen is elastic and deforms when it turns. This increases the load on the heating elements, and improves contact between the thermal paper S and the heating elements. Thermal conduction from the heating elements to the thermal paper therefore improves and sharp printing is possible. After printing, contact is held on the discharge side of the heating element center Ph, and any printing chaff and dust that sticks to the print head surface can be wiped off to the discharge side. The heat stored in the glazed layer also works to prevent the printing chaff from fixing on the head. Even if some printing chaff does adhere, it adheres at a place separated from the heating elements, and the effect on print quality is therefore reduced.

Tests showed that the distance between the platen center Pc and the heating element center Ph is optimally 0.2 mm to 0.5 mm. If greater than 0.5 mm, contact between the heating elements and the platen becomes weaker and print tends to be lighter.

Figure 7A:
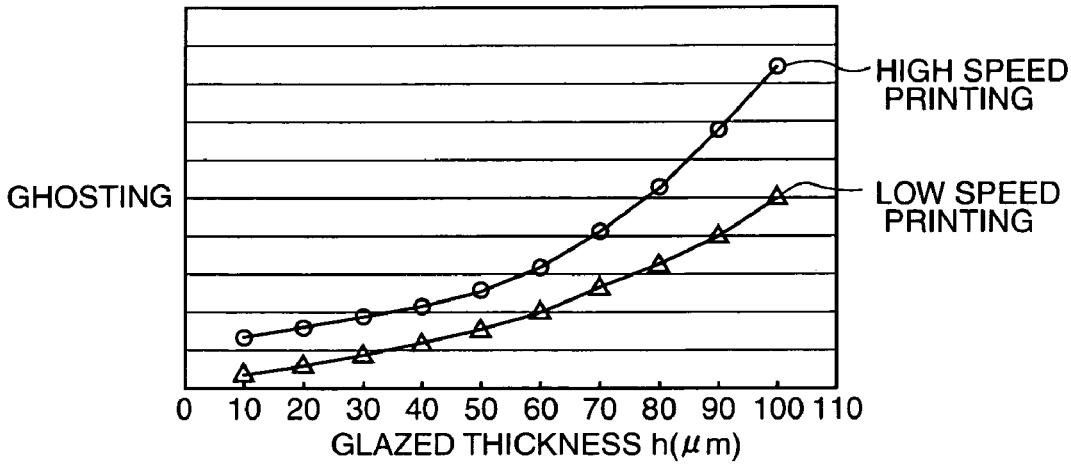
FIG. 7A is a graph describing the relationship between the thickness of the glazed layer and the tendency for ghosting of the printed image.

The dimensions of the glazed layer 150 are described next with reference to FIG. 7A to FIG. 7C. FIG. 7A shows the relationship between the thickness (h) of the glazed layer 150 and the tendency for ghosting of the printed image. High speed printing here indicates a paper speed near the thermal head 39 of approximately 170-200 mm/s. Low speed printing indicates a paper speed near the thermal head 39 of less than approximately 150 mm/s.

As shown in FIG. 7A, when the thickness (h) of the glazed layer is thin, the heat storage capacity of the glazed layer 150 drops and thermal response improves, and ghosting is therefore reduced and print quality improved, whether during high speed printing or low speed printing. The thickness (h) of the glazed layer 150 is therefore as thin as possible, but when the thickness (h) of the glazed layer 150 was less than 20 μm in this embodiment of the invention, the heat storage effect was minimal and the print density was light.

Figure 7B:
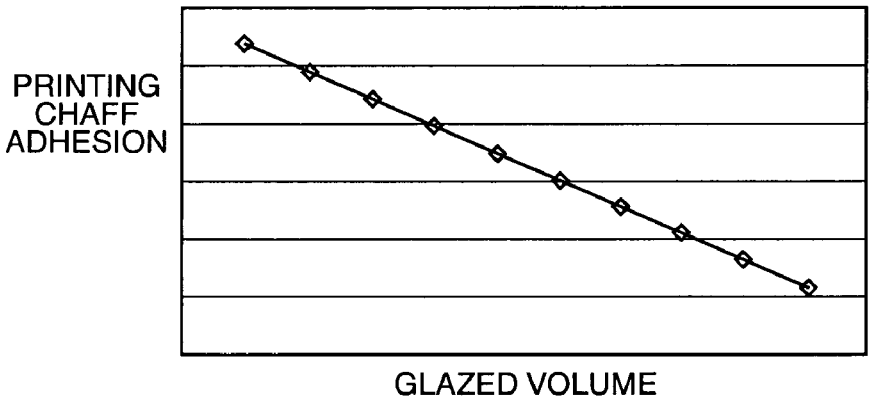
FIG. 7B shows the relationship between the volume of the glazed layer and the tendency for adhesion of printing chaff.

FIG. 7B shows the relationship between the volume of the glazed layer 150 and the tendency for adhesion of printing chaff. As shown in FIG. 7B, printing chaff adhesion declines as the glazed layer 150 volume increases. However, if the thickness (h) of the glazed layer 150 exceeds 50 μm, heat storage increases, ghosting increases, and print quality decreases. As a result, the thickness (h) of the glazed layer 150 in this embodiment of the invention is preferably 20-50 μm.

Figure 7C:
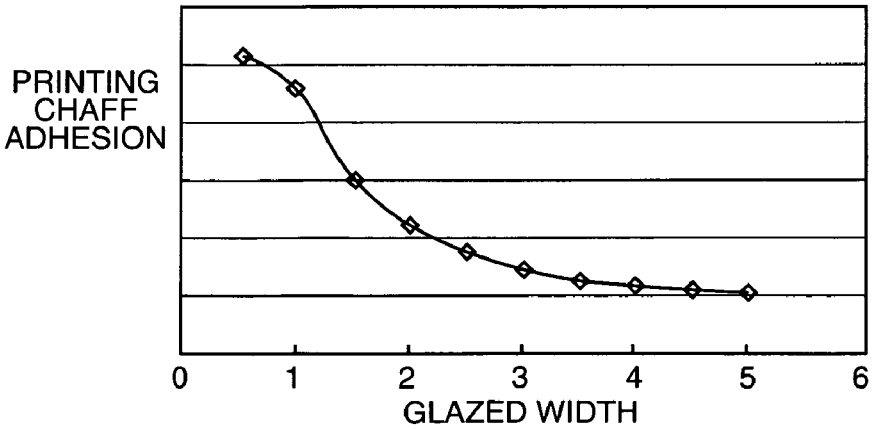
FIG. 7C shows the tendency for printing chaff adhesion relative to the width of the glazed layer.
Figure 8:
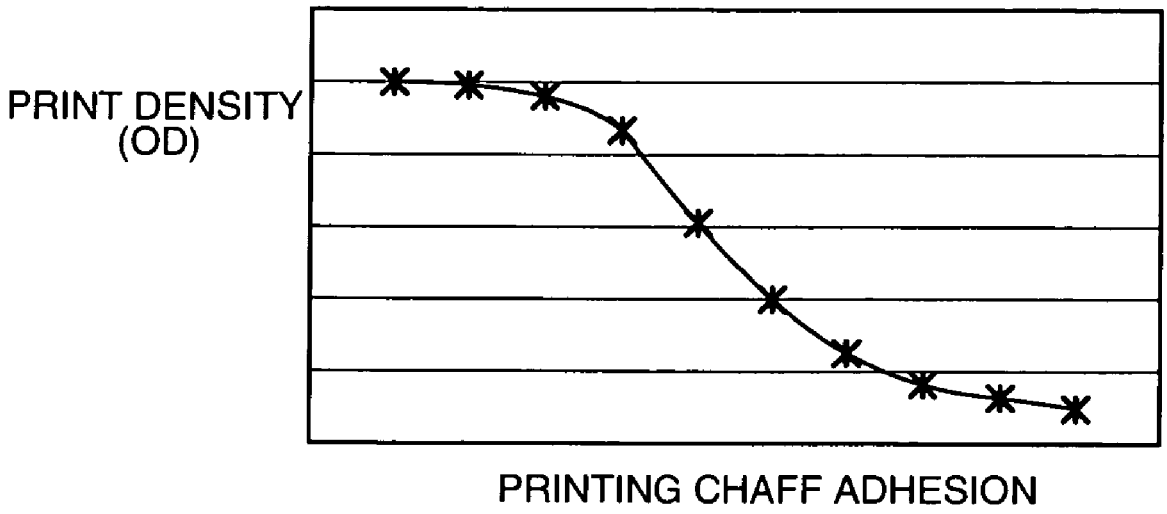
FIG. 8 shows the relationship between print density and printing chaff adhesion.

FIG. 7C shows the tendency for printing chaff adhesion relative to the width (W) of the glazed layer 150 when the thickness (h) of the glazed layer 150 was 20-50 μm. As shown in FIG. 7C, when the width (W) of the glazed layer 150 exceeds 1.5 mm, there is a rapid drop in the adhesion of printing chaff. The width (W) of the glazed layer 150 in this embodiment of the invention is therefore preferably 1.5 mm or greater. By using a glazed layer 150 of these dimensions, the thermal head 39 significantly reduces ghosting and printing chaff adhesion compared with the related art and print quality is not degraded.

Figure 6C:
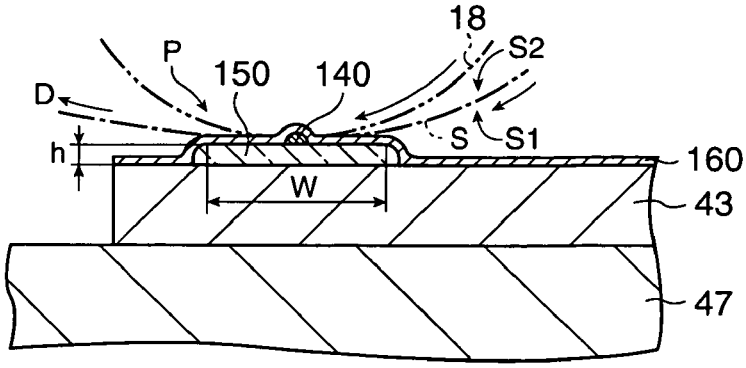
FIG. 6C is another section view of the thermal head.

A preferred embodiment of the invention is described above with reference to the accompanying figures, but the actual configuration of the invention is not limited to the foregoing embodiment and can be varied in many ways without departing from the scope of the accompanying claims. For example, as shown in FIG. 6C, the heating resistor 140 could be disposed in the middle of the glazed layer 150.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:
a thermal head that prints on thermal paper; and
a roller that is disposed opposite the thermal head with the thermal paper therebetween and conveys the thermal paper;
wherein the thermal head includes
a substrate;
a heat storage layer formed on a part of the substrate for storing input heat; and
a heating element formed on the heat storage layer for melting a dye agent contained in the thermal paper; and
the heating element is disposed on an upstream side in a thermal paper transportation direction from a center of the heat storage layer;
wherein the width from the upstream edge of the heating element to the edge of the heat storage layer is 1.5 mm or greater toward the transportation direction of the thermal paper.

2. The printer described in claim 1, wherein:
a surface is formed parallel to the substrate-contacting the thermal paper on the heat storage layer downstream in the thermal paper transportation direction from the heating element.

3. The printer described in claim 1, wherein:
the thickness of the heat storage layer is uniform.

4. The printer described in claim 1, wherein:
the heating element is aligned in a direction intersecting the transportation direction of the thermal paper.

5. The printer described in claim 1, wherein:
the roller is disposed so that the position where a perpendicular to the substrate of the thermal head passing through the axial center of the roller intersects the thermal head is located on the downstream side in the thermal paper transportation direction from the position where the heating element is formed.

6. A thermal head that presses against thermal paper that moves from one side to the other side and prints by melting dye agents contained in the thermal paper, comprising:
a substrate;
a heat storage layer formed on the substrate for storing input heat; and
a heating element for melting a dye agent contained in the thermal paper by selectively heating the thermal paper;
wherein the heating element is formed on the heat storage layer, and is disposed at a position upstream from a center of the heat storage layer, and
wherein the width from the upstream edge of the heating element to the edge of the heat storage layer is 1.5 mm or greater toward the transportation direction of the thermal paper.

7. A printer comprising:
a thermal head; and
a roller that is disposed opposite the thermal head with the paper therebetween and conveys the paper;
wherein the thermal head includes:
a substrate; and
a heat storage layer formed on a part of the substrate for storing input heat,
wherein the roller is disposed so that a position where a perpendicular to the substrate of the thermal head passing through an axial center of the roller intersects the thermal head is located on the downstream side in the paper transportation direction from the position where a heating element is formed, and
wherein the width from the upstream edge of the heating element to the edge of the heat storage layer is 1.5 mm or greater toward the transportation direction of the thermal paper.

8. A printer comprising:
a thermal head that prints by melting dye agents contained in thermal paper; and
a roller that is disposed opposite the thermal head with the thermal paper therebetween and conveys the thermal paper;
wherein the thermal head includes:
a substrate;
a heat storage layer formed on a part of the substrate for storing input heat; and
a heating element formed on the heat storage layer for melting a dye agent contained in the thermal paper; and
the length in a thermal paper transportation direction from the heating element to an end of the heat storage layer is 1.5 mm or more;
wherein the width from the upstream edge of the heating element to the edge of the heat storage layer is 1.5 mm or greater toward the transportation direction of the thermal paper.

* * * * *